US006123198A

United States Patent [19]

Pflueger et al.

[11] Patent Number: 6,123,198

[45] Date of Patent: Sep. 26, 2000

[54] COSMETIC CARRIER

[75] Inventors: D. Russell Pflueger; Rebecca J. Pflueger, both of San Juan Capistrano, Calif.

[73] Assignee: English Ideas, Ltd., Iruine, Calif.

[21] Appl. No.: 09/270,868

[22] Filed: Mar. 17, 1999

Related U.S. Application Data

[60] Provisional application No. 60/078,853, Mar. 20, 1998.

[51] Int. Cl.[7] ..... B65D 69/00

[52] U.S. Cl. ..... 206/581; 206/523; 206/823; 132/318

[58] Field of Search ..... 206/581, 823, 206/523, 6.1, 566, 217; 220/669, 592.16, 592.17; 132/314, 316, 317, 318; 224/926, 281, 539

[56] References Cited

U.S. PATENT DOCUMENTS

| | | | |
|---|---|---|---|
| 1,906,822 | 5/1933 | Shields | 206/6.1 |
| 2,895,636 | 7/1959 | Martin | 220/592.16 |
| 4,106,597 | 8/1978 | Shook et al. | 190/42 |
| 4,294,349 | 10/1981 | Ibsen et al. | 206/63.5 |
| 4,681,219 | 7/1987 | Kitchens | 206/315.11 |
| 4,763,791 | 8/1988 | Halverson et al. | 206/570 |
| 4,836,374 | 6/1989 | Hutchins et al. | 206/373 |
| 4,848,586 | 7/1989 | Jasik | 206/586 |
| 4,872,563 | 10/1989 | Warder et al. | 206/523 |
| 5,291,997 | 3/1994 | He et al. | 206/370 |
| 5,330,056 | 7/1994 | De La Rocha | 206/581 |
| 5,372,252 | 12/1994 | Alexander | 206/210 |
| 5,706,969 | 1/1998 | Yamada et al. | 220/422 |
| 5,860,755 | 1/1999 | Bunk | 132/316 |
| 5,995,573 | 11/1999 | Murray, Jr. | 376/272 |

*Primary Examiner*—Paul T. Sewell
*Assistant Examiner*—Nhan T. Lam
*Attorney, Agent, or Firm*—Stout, Uxa, Buyan & Mullins

[57] ABSTRACT

Apparatus for carrying cosmetics include a cup member, a holder member and a cover. The cup member has a closed first end and an open second end and defines a hollow space therebetween. The holder member is sized and adapted to be placed in the hollow space and includes a plurality of spaced apart recesses each of which is sized to receive a cosmetic product. The cover is adapted to be detachably secured to the cup member to cover the open second end. The present apparatus are very effective and convenient for holding cosmetic properties in automobiles and other transportation vehicles.

19 Claims, 1 Drawing Sheet

COSMETIC CARRIER

CROSS REFERENCE TO RELATED APPLICATION

This application claims the benefit of U.S. Provisional Application No. 60/078,853, filed Mar. 20, 1998 and entitled COSMETIC CARRIER.

BACKGROUND OF THE INVENTION

The present invention relates to apparatus for carrying cosmetics. More particularly, the present invention relates to apparatus for carrying cosmetics, such as lipstick, other lip cosmetics, mascara, other eye cosmetics, skin care products and the like.

Although cosmetics are very often applied in the home, there are occasions when one or more cosmetic products are applied while in transit or at remote locations. For example, in between meetings or other engagements, one may desire to apply lipstick, mascara, skin care products and the like at remote locations or in an automobile or other transportation vehicle. Carrying a ready supply of such cosmetics can be difficult, particularly if one carries a relatively small purse or no purse at all. On the other hand, leaving such cosmetic products in the automobile or other vehicle can result in the products becoming melted or otherwise damaged because of excessive or elevated temperatures in the vehicle.

It would be advantageous to provide a system which can be used to store cosmetic products ready for use in remote locations and/or in automobiles and other transportation vehicles.

SUMMARY OF THE INVENTION

New cosmetic carriers have been discovered. Such apparatus very conveniently and effectively provide for storing of cosmetic products, for example, while at the beach, swimming pool or other outdoor activity or in automobiles and other transportation vehicles, ready for use. Importantly, the present apparatus provide the cosmetic products in such a way as to be very convenient to use. Also, during periods of cosmetic product storage, the present apparatus are designed to reduce the deleterious effect or effects on such products caused by elevated temperatures, for example, which may occur in the outdoors or in the vehicle. The present apparatus are straightforward in construction, easy to use and maintain and to carry, for example, in a beach or pool bag or in an automobile or other transportation vehicle.

In one broad aspect of the present invention, cosmetic carrier apparatus are provided which comprise a cup member and a cover. The carrier preferably includes a holder member. The cup member has a closed first end and an open second end and defines a hollow space in between the two ends. Each of the recesses is sized to receive, and preferably hold, a cosmetic product. The cover is adapted to be detachably secured to the cap member to cover the open second end. The holder member is sized and adapted to be placed, and preferably held, in the hollow space and includes a plurality of spaced apart recesses.

In one very useful embodiment, the cup member is structured so as to, together with the cover secured to the open second end, insulate the hollow space, and the cosmetic products located in the hollow space, from excessive or elevated temperature outside the hollow space. Such construction reduces the deleterious effect or effects such elevated temperature may have on the cosmetic products. In a specific embodiment, the cup member includes an inner sidewall and a spaced apart outer sidewall which, together with the cover, cooperate to insulate the hollow space, and in particular, the cosmetic products located in the hollow space, from elevated temperatures outside the hollow space. Of course, other cup member structures or constructions can be used to provide the desired degree of heat/temperature insulation.

The cup member preferably is made of a polymeric material, for example, such as polystyrene, vinyl and the like. The cup member preferably is sized to be received in a standard or conventional beverage holder in an automobile or other transportation vehicle. Very often, such beverage holders are within the reach of the vehicle driver or the passenger located in the front seat of the vehicle. Thus, with the cup member being sized to be located in the beverage holder, the cosmetic products in the hollow space are readily available for use, for example, while the driver or passenger is seated in the vehicle.

The cup member preferably has no handle or handles which extend outwardly from the outer sidewall of the cup member. In order to make the apparatus visually pleasing, the outer sidewall surface of the cup member facing away from the hollow space preferably is ornamentally decorated, for example, with decorative printing, pictures and the like.

The cover preferably includes a mirrored surface, for example, facing toward or away from the hollow space when the cover is secured to the cup member to cover the open second end. This mirrored surface can be used effectively in applying a cosmetic product which has been stored in the carrier apparatus to one's face.

The holder member preferably is made of polymeric material, more preferably of a polymer foam, and still more preferably of a resilient polymer foam. Using a holder member made of foam is very effective in holding the cosmetic products (in the recesses in the foam) and greatly reduces or even eliminates noise, e.g., rattling, created by the cosmetic products moving about the hollow space. The holder member preferably is sized to be held by the cup member in the hollow space between the closed first end and the open second end of the cup member. In other words, the holder member preferably does not touch the closed first end and does not extend to the open second end of the cup member.

The holder member preferably is sized to be held snugly in the hollow space. Thus, the holder member preferably is not adhesively or otherwise secured to the cup member other than by a friction or interference fit. Further, the holder member preferably is adapted to be removed from the hollow space, for example, as desired, to be replaced by a new holder member, for example, having differently sized and/or configured recesses more suitable for the cosmetic products sought to be stored.

In one particularly useful embodiment, at least one of the recesses extend through the holder member. More preferably, all the recesses extend through the holder member.

The recesses in the holder member preferably are differently sized and/or differently configured. Thus, for example, at least one of the recesses may have a circular cross-section while at least one of the recesses is rectangular, e.g., square, in cross-section. The differences in size and/or configuration of the recesses is important in that cosmetic products located in different sized and/or shaped containers can be carried by the present apparatus.

The number of recesses in an individual holder member preferably is in a range of 2 to 6, more preferably, 2 to 4.

Each and every combination of two or more features disclosed herein can be used together provided that such features are not mutually inconsistent. All such combinations are included within the scope of the present invention.

These and other aspects and advantages of the present invention are apparent in the following detailed description and claims, particularly when considered in conjunction with the accompanying drawings.

DETAILED DESCRIPTION OF THE DRAWINGS

Figure 1:
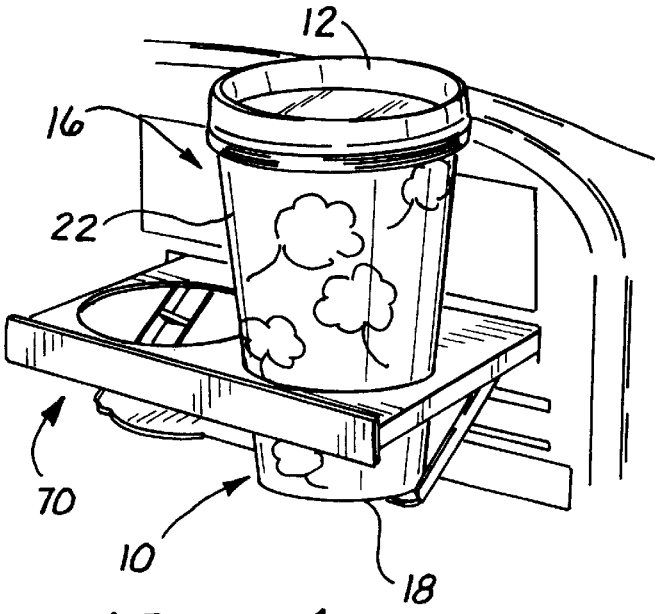
FIG. 1 is a front side view, in perspective, of a cosmetic carrier in accordance with the present invention located in the beverage carrier of an automobile.
Figure 2:
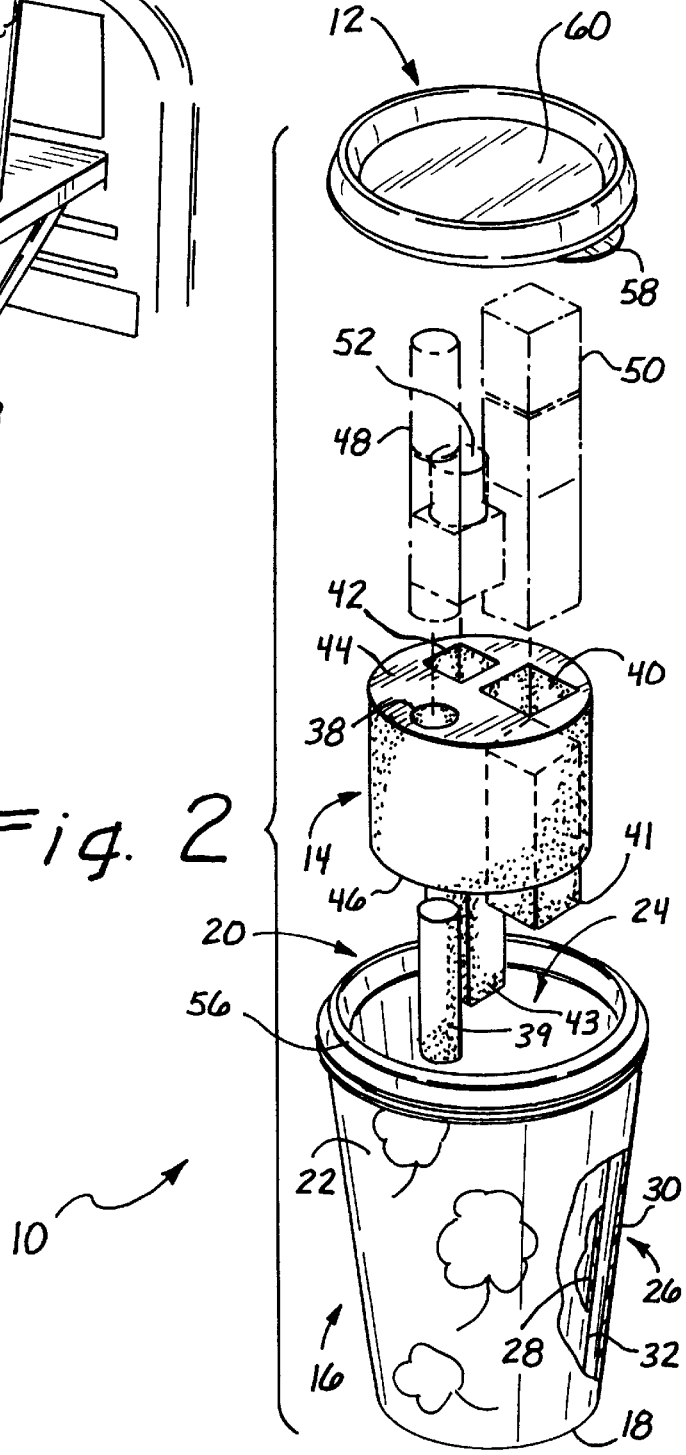
FIG. 2 is a front exploded view, in perspective, of the cosmetic carrier shown in FIG. 1.

Referring now to the drawings, a cosmetic carrier shown generally at 10, includes a cover 12, a holder element 14 and a cup 16. The cup 16 includes a closed bottom end 18 and an open top end 20. A decorated outer insulating sidewall surface 22 is located between the bottom end 18 and top end 20 of the cup 16.

The cup 16 defines a hollow space 24 located between the bottom end 18 and the top end 20 and the sidewall structure 26. The sidewall structure 26 includes an inner sidewall 28 which extends from the inner bottom to the top end 20 of the cup 16. Outer sidewall 30 is spaced apart from inner sidewall 28 and extends from the bottom end 18 to the top end 20. The inner sidewall defines an inner bottom which is spaced apart from and substantially coextensive with the bottom end 18 of cup 20. The spaced apart orientation of inner sidewall 28 and outer sidewall 30 is effective to provide an air gap 32 therebetween. This spaced apart construction is effective in insulating the hollow space 24 from elevated or excessive temperatures located outside of outer sidewall 30. Thus, with cover 12 located over top end 20 and secured to cup 16, hollow space 24 is thermally insulated from the exterior of cup 16.

The cup 16 is made of a polymeric material, such as vinyl. The cup 16 can be produced in a suitable manner, for example, such as that used to produce thermally insulated beverage containers. The outer sidewall surface 22 of cup 16 is provided with an ornamental decorative design, for example, a floral design shown in the drawings.

Holder element 14 is made of polymeric foam, for example, a poly ether-type material, which is gray in color and is sized and adapted to be held in the hollow space 24 between the top end 20 and bottom end 18 (above the inner bottom) of the cup 16. In other words, holder element 14 does not touch the bottom end 18 of the cup 16 nor extend beyond the top end of the cup. Also, because holder element 14 is made of a relatively resilient polymeric foam, it can be snugly fit or wedged into the hollow space 24 without being adhered or otherwise positively attached to the cup 16. Thus, if desired, the holder element 14 can be relatively easily removed from the hollow space 24.

A series of three through recesses or holes 38, 40 and 42 are located in the holder element 14 and extend through the holder element from the top 44 to the bottom 46. Each of the through holes 38, 40 and 42 has a different size or cross-section. Also, while through hole 38 is circular in cross-section, both through holes 40 and 42 are rectangular, in particular, square, in cross-section. Each of the through holes 38, 40 and 42 is designed to receive and hold a different cosmetic product. For example, through hole 38 is designed to receive and hold mascara container 48, through hole 40 is designed to receive and hold lipstick container 50 and through hole 42 is designed to receive and hold lipstick sealant container 52. Of course, the through holes in holder element 14 can be differently sized and/or configured to receive and hold different cosmetic products. In any event, the holder element 14 is designed so as to hold the cosmetic products in such a way to reduce or even eliminate noise, e.g., rattling, which would result from the cosmetic products moving around in the hollow space 24 in the cup 16.

The holder element 14 is sized so as to fit sufficiently low in the hollow space 24 So that the tops of the cosmetic products 48, 50 and 52 being held by the holding element 14 do not extend beyond the top 20 of the cup 16 and can easily be grasped for removal. Removable inserts 39, 41, and 43 are adapted to fit into through holes 38, 40 and 42, respectively, to a distance so that the cosmetic products 48, 50 and 52, respectively can be maintained at a desired level in holder element 14. One or more of the inserts 39, 41 and 43 may be completely removed from the through holes 38, 40 and 42, respectively, if such insert or inserts are not needed.

The cover 12 is designed to be secured to the top rim 56 of cup 16. In the embodiment shown in the drawings, cover 12 includes a groove which is adapted to snap onto top rim 56. A tab 58 is included on cover 12 and can be used to manually pry the cover from the top rim 56. In addition, cover 12 includes a mirrored surface 60 which faces away from the hollow space 24 when the cover is on the cup 16. This mirrored surface can be used in applying the cosmetic products stored in the hollow space 24.

With reference to FIG. 1, the assembled cosmetic carrier 10, and in particular, cup 16, is sized so as to be received and held in the beverage holder 70 of an automobile, for example, in the front seat located between the driver and the front seat passenger of the automobile. Thus, when the driver or a passenger in the automobile wishes to apply one or more cosmetic products to her face, she simply removes the cover 12 from the cup 16, removes one of the cosmetic products 48, 50 and 52 from the holder element 14 and applies that cosmetic product to her face. The mirrored surface 60 of cover 12 can be used in properly directing the application of the cosmetic product. After cosmetic application, the cosmetic product is again placed in the appropriate through hole in holder element 14 and the cover 12 is replaced on the cup 16.

Because the hollow space 24 is heat/temperature insulated, the cosmetic carrier 10 can be conveniently taken and used at other outdoor activities, for example, at the swimming pool, beach, sporting activities and the like. Because of this heat/temperature insulation, the cosmetic products in hollow space 24 remain unmelted and otherwise undamaged even in relatively hot outdoor conditions. Thus, these cosmetic products can be conveniently applied, as noted above, from carrier 10.

While this invention has been described with respect to various specific examples and embodiments, it is to be understood that the invention is not limited thereto and that it can be variously practiced within the scope of the following claims.

What is claimed is:

1. A cosmetic carrier comprising:

a cup member having a closed first end and an open second end and defining a hollow space therebetween;

a holder member having a top end sized and adapted to be placed in the hollow space and including a plurality of spaced apart apertures extending inwardly from the top end, each aperture is sized to receive a cosmetic product;

a cover separate from the cup member and adapted to be secured to the cup member to cover the open second end, and further adapted to be detached from the cup member, as desired; and a plurality of cosmetic products each of which being received in one of the apertures.

2. The carrier of claim 1 wherein the cup member is made of a polymeric material and is sized to be received and held in a beverage container in an automobile.

3. The carrier of claim 1 wherein the cup member includes an outer sidewall having a circular cylindrical configuration, and the cup member has no handle extending outward from the outer sidewall.

4. The carrier of claim 3 wherein the cup member includes an outer sidewall surface facing away from the hollow space, the outer sidewall surface being ornamentally decorated.

5. The carrier of claim 1 wherein the holder member is made of polymeric material.

6. The carrier of claim 1 wherein the holder member is made of polymer foam.

7. The carrier of claim 1 wherein the holder member is sized to be held by the cup member in the hollow space between the closed first end and the open second end.

8. The carrier of claim 1 wherein the holder member is sized to be held snugly by the cup member in the hollow space.

9. The carrier of claim 8 wherein the holder member is sized, structured and adapted to be removable from the hollow space.

10. The carrier of claim 1 wherein the apertures are differently sized.

11. The carrier of claim 1 wherein the apertures are differently configured.

12. The carrier of claim 1 wherein at least one aperture is circular in cross-section and at least one aperture is rectangular in cross-section.

13. The carrier of claim 1 wherein the number of apertures is in a range of 2 to 6.

14. A cosmetic carrier comprising:

a cup member having a closed first end an open second end and defining a hollow space therebetween, and an inner sidewall and a spaced apart outer sidewall having a circular cylindrical configuration, the cup member being sized to be received and held in a beverage container in an automobile;

a cover separate from the cup member and adapted to be secured to the cup member to cover the open second end, and further adapted to be detached from the cup member, as desired;

a plurality of cosmetic products located in the hollow space and the cup member further including an inner sidewall spaced apart from the outer sidewall, the inner sidewall and the outer sidewall, together with the cover, cooperate to insulate the hollow space and the cosmetic products in the hollow space from elevated temperature outside the hollow space.

15. A cosmetic carrier comprising:

a cup member having a closed first end and an open second end and defining a hollow space therebetween;

a holder member having a top end sized and adapted to be placed in the hollow space and including a plurality of spaced apart apertures extending inwardly from the top end, each aperture is sized to receive a cosmetic product;

a cover separate from the cup member and adapted to be secured to the cup member to cover the open second end, and further adapted to be detached from the cup member, as desired; and a cosmetic product received in one of the apertures, and the cup member includes an inner sidewall and a spaced apart outer sidewall which, together with the cover, cooperate to insulate the hollow space and the cosmetic product from elevated temperature outside the hollow space.

16. The carrier of claim 15 wherein the cup member is made of a polymeric material and is sized to be received and held in a beverage container in an automobile.

17. A cosmetic carrier comprising:

a cup member having a closed first end and an open second end and defining a hollow space therebetween;

a holder member having a top end sized and adapted to be placed in the hollow space and including a plurality of spaced apart apertures extending inwardly from the top end, each aperture is sized to receive a cosmetic product;

a cover separate from the cup member and adapted to be secured to the cap member to cover the open second end, and further adapted to be detached from the cup member, as desired; and the cover including a mirrored surface facing away from the hollow space when the cover is secured to the cup member to cover the open second end.

18. The carrier of claim 17 wherein the cup member is made of a polymeric material and is sized to be received and held in a beverage container in an automobile.

19. The carrier of claim 17 wherein the holder member is sized, structured and adapted to be removable from the hollow space.

* * * * *